US005657835A

United States Patent [19]

Bittar

[11] Patent Number: 5,657,835

[45] Date of Patent: Aug. 19, 1997

[54] ELEVATOR SHUTTLE EMPLOYING HORIZONTALLY TRANSFERRED CAB

[75] Inventor: Joseph Bittar, Avon, Conn.

[73] Assignee: Otis Elevator Company, Farmington, Conn.

[21] Appl. No.: 564,754

[22] Filed: Nov. 29, 1995

[51] Int. Cl.[6] ..... B66B 9/00

[52] U.S. Cl. ..... 187/249; 187/256

[58] Field of Search ..... 187/256, 239, 187/249, 410; 182/14, 12, 13

[56] References Cited

U.S. PATENT DOCUMENTS

| | | | |
|---|---|---|---|
| 1,939,729 | 12/1933 | Stark | 187/1 |
| 2,052,690 | 9/1936 | Austin | 187/16 |
| 5,090,515 | 2/1992 | Takahashi et al. | 187/16 |

FOREIGN PATENT DOCUMENTS

| | | | |
|---|---|---|---|
| 0615946 | 9/1994 | European Pat. Off. | B66B 9/02 |
| 2203864 | 2/1973 | Germany | B61B 3/02 |
| 4-153187 | 5/1992 | Japan . | |
| 9108161 | 6/1991 | WIPO | B66B 9/00 |

OTHER PUBLICATIONS

Japanese Abstract, vol. 018, No. 487 (M-1671), 12 Sep. 1994 & JP 06 156928 A (Toshiba Corp), 3 Jun. 1994.

Japanese Abstract, vol. 018, No. 487 (M-1671), 12 Sep. 1994 & JP 06 156939 A (Toshiba Corp), 3 Jun. 1994.

*Primary Examiner*—Kenneth Noland

[57] ABSTRACT

A horizontally moveable elevator cab (14) is transferred between a plurality of car frames (16–18) in successive hoistways (11–13) by horizontal motive means (44–47) in response to a signal processing controller (43, FIGS. 4 and 5).

5 Claims, 8 Drawing Sheets

| FIG. 4A | FIG. 4B |
|---|---|

| FIG.5A |
|---|
| FIG.5B |

ELEVATOR SHUTTLE EMPLOYING HORIZONTALLY TRANSFERRED CAB

TECHNICAL FIELD

This invention relates to moving elevator cabs upwardly through a building by transferring the cabs from a first hoistway to a second hoistway, from the second hoistway to a third hoistway, and so forth.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and power consumption are prohibitively large.

DISCLOSURE OF INVENTION

Objects of the invention include moving passengers in very tall buildings without the need for walking between elevator groups at a sky lobby, and moving elevator cabs in a building vertical distances which exceed the practical length of conventional elevators.

According to the invention, in order to reach longer distances, an elevator cab may be moved in a first car frame in a first hoistway, from the ground floor up to a transfer floor, moved horizontally into a second elevator car frame in a second hoistway, and moved therein upwardly in the building, and so forth.

In accordance with the present invention, a selectively operable horizontal motive means is operated by signal processing means in response to a transfer signal when the car is at a landing that is not a lobby landing. According to the invention further, when the car leaves a lobby landing, the transfer signal is provided. In accordance still further with the invention, the transfer signal is provided whenever a car approaches a transfer landing. The signal processing means provides direction signals whenever a car has a cab in it in the absence of said transfer signal.

The invention allows moving an elevator cab throughout two or more times the maximum distance of an elevator roping system. The invention avoids the disruption to passenger traffic which results from having passengers transfer from one elevator system to another, by foot, at sky lobbies.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
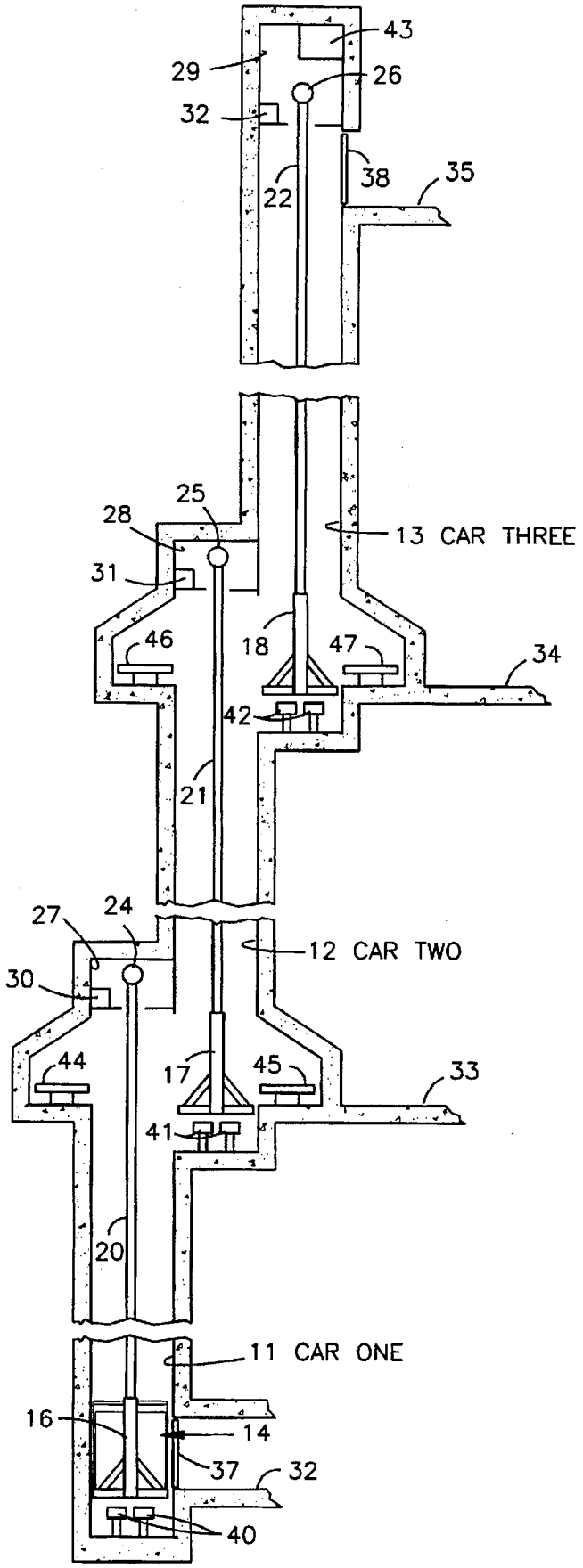
FIG. 1 is a simplified, stylized, partial, side elevation view of an elevator system in accordance with the invention.

Referring now to FIG. 1, an elevator system comprises three offset hoistways 11–13 each of which contains a complete elevator, except for the passenger-containing cab portion, there being a single cab 14 which is transferred between the three hoistways 11–13. Each elevator includes a frame 16–18, hoist ropes 20–22, a hoisting machine 24–26, including a motor, a sheave and a brake, disposed in a machine room 27–29 along with a car controller 30–32. For control purposes herein, the elevators in hoistways 11–13 are referred to as car one, car two and car three, respectively. Car one carries passengers between a lobby floor 32 and a first transfer floor 33, which represents a low floor for car two; a second transfer floor 34 represents a high floor for car two. Car three transfers passengers between the high transfer floor 34 and an upper lobby floor 35, sometimes referred to as a "sky lobby", which may be a restaurant floor, an observation floor, or a lobby from which passengers may embark to still higher (or lower) floors by means of local elevators (with or without express runs). Access between the elevator cab 14 and the lobby floors 32 and 35 is provided by hoistway doors 37 and 38, respectively. The bottom of each hoistway 11–13 may contain a buffer 40–42, as is known. Each elevator may have other equipment, such as a counterweight, governor, safeties and the like, none of which are special for the present invention and therefore need not be shown herein. A group controller 43 may control the overall operation, as described with respect to FIGS. 4 and 5, hereinafter.

Figure 2:
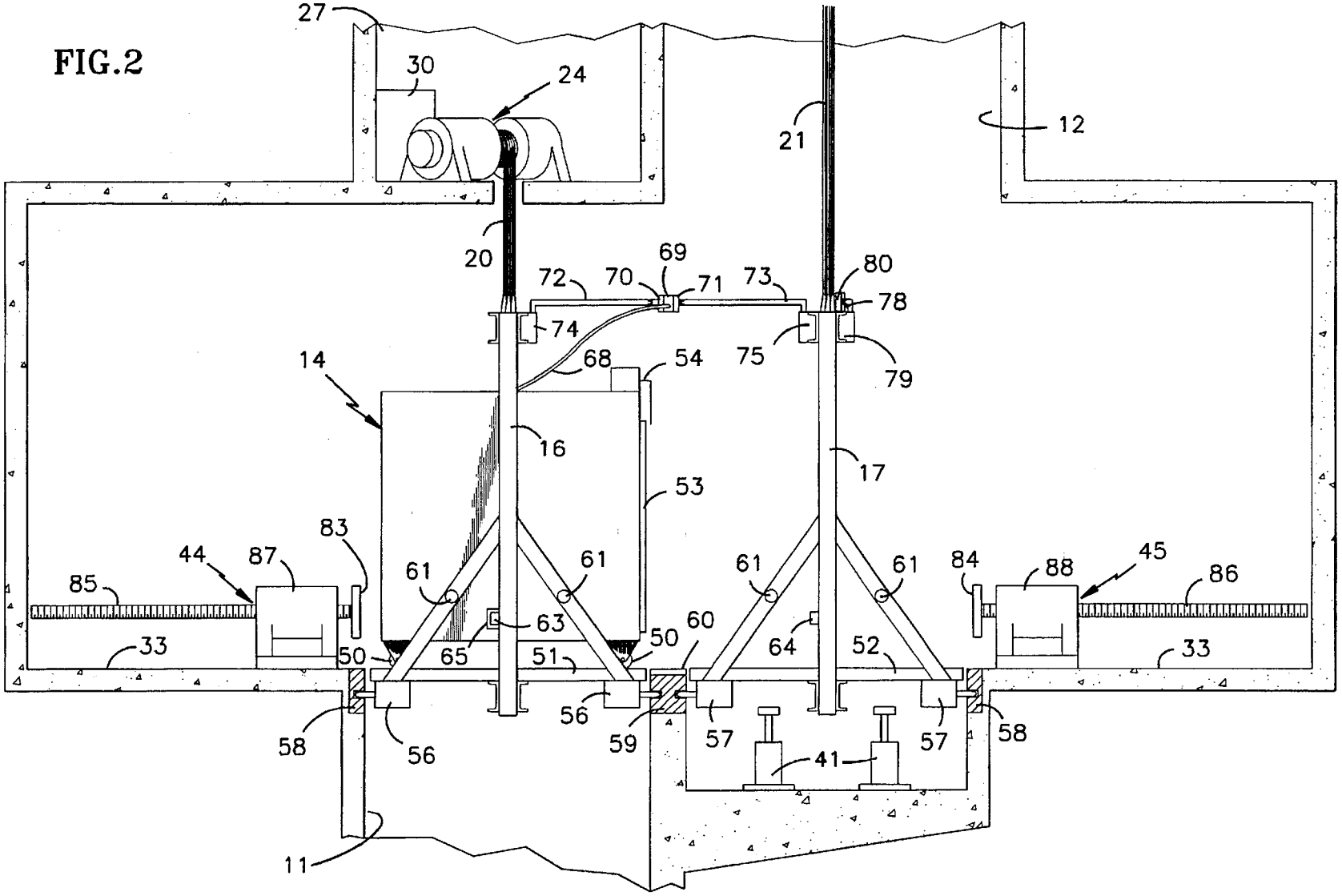
FIG. 2 is a simplified, stylized, partial, side elevation view of an elevator system of FIG. 1, showing additional detail at a transfer floor.

At each transfer floor there are provided horizontal motive means, such as jack screw assemblies 44–47 for transferring the cab 14 from one frame 16–18 of one of the cars to a frame of another of the cars, as illustrated more fully in FIG. 2. Therein, the cab 14 is shown disposed on wheels 50 to permit rolling the cab 14 from a platform 51 of the frame 16 to a platform 52 of a frame 17. The cab 14 has doors 53 of the usual type operated by a door operating mechanism 54 to allow passenger access to the lower and upper lobby floors 32, 35. However, the doors are not opened at the transfer floors 33, 34. Each of the cars is provided with floor locks 56, 57 which may, in this embodiment, simply comprise bistable solenoid plungers which can be moved into a locked position, where the plunger engages a plate 58, 59 supported in the hoistway. Use of a dual coil, bistable solenoid allows energizing one coil to cause the plunger to engage as shown, after which the coil can be disenergized and the plunger will remain engaged; when the car is to move, the opposite coil can be operated to move the plunger out of engagement, and thereafter the plunger will remain out of engagement until the other coil is once again operated. The use of the floor locks 56, 57 is to reduce erratic motion of the frame 16, 17 due to variations in rope stretch, as the cab is transferred from one frame to the other. The plate 59 may be combined with a sill 60 that allows the cab 14 to roll from one frame (16) to another frame (17). Each of the car frames 16–18 also has a cab/car lock system which may comprise plungers 61 which can move inwardly toward the cab so as to engage plates on the cab, similar to the manner illustrated for the plungers 56 and plates 58. These are not otherwise shown in detail herein. Each frame may also have some form of proximity detector 63, 64 which can sense the presence of an element 65 on the cab 14, to provide a signal generally indicative of the fact that the cab is on a particular car.

Figure 3:
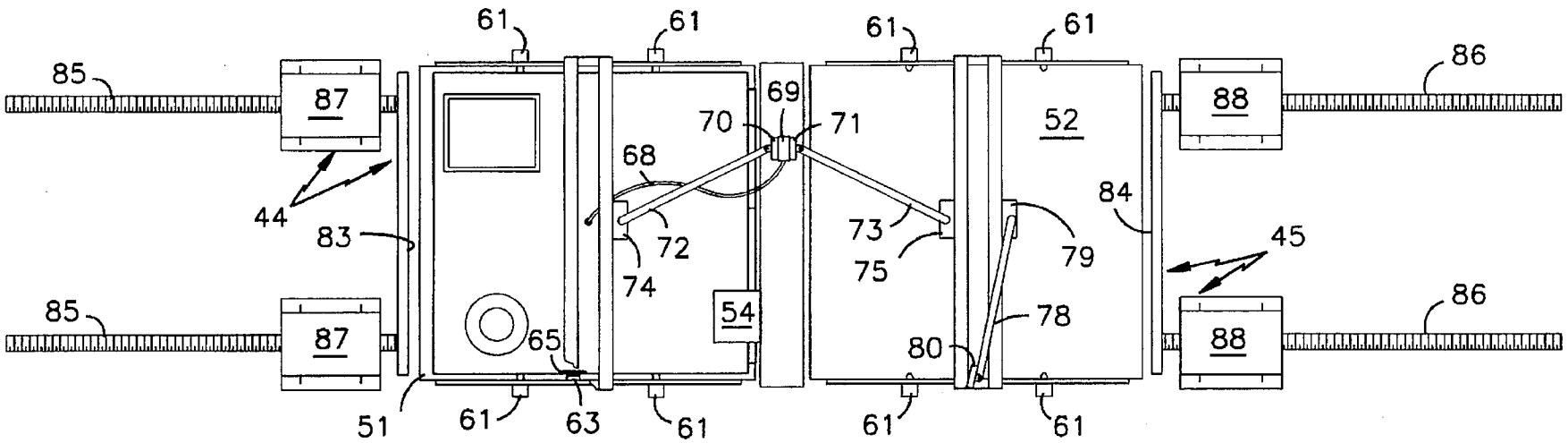
FIG. 3 is a partial, simplified, symbolic, top plan view of an elevator car at the transfer floor of FIG. 2.

In transferring the cab from one frame 16 to the other frame 17, it is desirable to maintain power for lighting in the cab, as well as to maintain signal circuitry for an alarm bell, a phone, and the door closure switch, at a minimum. In a shuttle system of the type illustrated in FIG. 1, traveling between two lobby floors 32, 35, with no choice as to any other destination floor, there is no need for a full car operating panel with car call buttons. Since the doors cannot be opened except when the cab is in car one at the lower lobby 32 and when the cab is in car three at the upper lobby 34, there is no need to maintain the capability for door opening as the cab 14 is transferred from one frame 16 to the other frame 17 (or vice versa). In the present embodiment, power for lighting and circuits for the signals referred to hereinbefore are maintained by means of an umbilical cable 68 which has a two sided plug-socket assembly 69 connected at its distal end, the proximal end entering the cab at its center (as shown in FIG. 3). The socket/plug 69, contains on both a right side and a left side as seen in FIGS. 2 and 3, a suitable number of pins and receptacles for the number of required circuits, which mate with a corresponding socket/plug assemblies 70, 71 attached to respective booms 72, 73 which are controlled by boom rotating mechanisms or operators 74, 75 on the respective frames 16, 17. The socket/plug assembly 69 is engaged with either one or the other of the socket/plug assemblies 70, 71, or both, at all times when the cab is on or between the car frames 16, 17. The frame 17 has a second boom 78 and boom operator 79 to use when the cab is transferring from the frame 17 of car 2 to the frame 18 of car 3 (FIG. 1). Each of the socket/plug assemblies 70, 71, 80 has a monostable solenoid plunger disposed therein which, in response to a release signal, will push the corresponding socket/plug assembly away from the socket/plug assembly 69 of the cab 14, so as to disengage therefrom, thereby permitting the boom 72, 73, 78 to be retracted when not in use. In order to effect transfer of cab communications from the boom 73 to the boom 78 after the cab is loaded onto frame 17 of car 2, the retracted position (as shown by the boom 78) of the booms 73 and 78 are adjacent, whereby the socket/plug assembly 69 can be transferred from boom 72 to boom 73, then to boom 78 and then to a similar boom on frame 18 of car 3 (not shown).

To move the cab. 14 from one frame to another, the jack screw assemblies 44, 45 each have a bumper 83, 84 which is driven by two screws 85, 86 in response to corresponding pairs of motors 87, 88. As is described with respect to FIGS. 4 and 5, this allows each car to move the cab 14 off itself, onto an adjacent car, at a transfer floor 33, 34.

In the embodiment of FIG. 1, each of the shafts 12, 13 is offset to the right of the shaft below it. However, the shaft 13 could be disposed to the left of the shaft 12, immediately above the shaft 11, if desired. Such a choice depends on building design criteria unrelated to the elevators. If such were the case, car two would only need a single boom 73 to interact with booms on both car one and car three.

For transferring the cab 14 from one frame to another, both frames are locked to the building by means of the simple plungers 56, 57 described hereinbefore. However, the best mode for locking the frame to the floor might be that disclosed in a commonly owned U.S. patent application Ser. No. 08/565,648, filed Nov. 29, 1995. Similarly, the cab 14 is locked into the frame in which it is riding by means of simple plungers 60, 61, described hereinbefore. However, the best mode for locking the cab in a frame during car travel might be that disclosed in commonly owned U.S. patent application Ser. No. 08/565,658, filed Nov. 29, 1995. The invention has been shown employing adjacent elevator shafts so that the travel distance for the cab is simply the width of a car frame, plus the width of the narrow sill 60 described hereinbefore. However, by providing for maintenance of communications and power during transfer, such as in the manner described in commonly owned co-pending U.S. patent application Ser. No. 08/630,223, filed Apr. 10, 1996 now U.S. Pat. No. 5,601,156, a continuation-in-part of Ser. No. 08/565,647, filed Nov. 19, 1995, the cab 14 may travel a much greater distance between cars within the purview of this invention.

Figures 4, 4A:
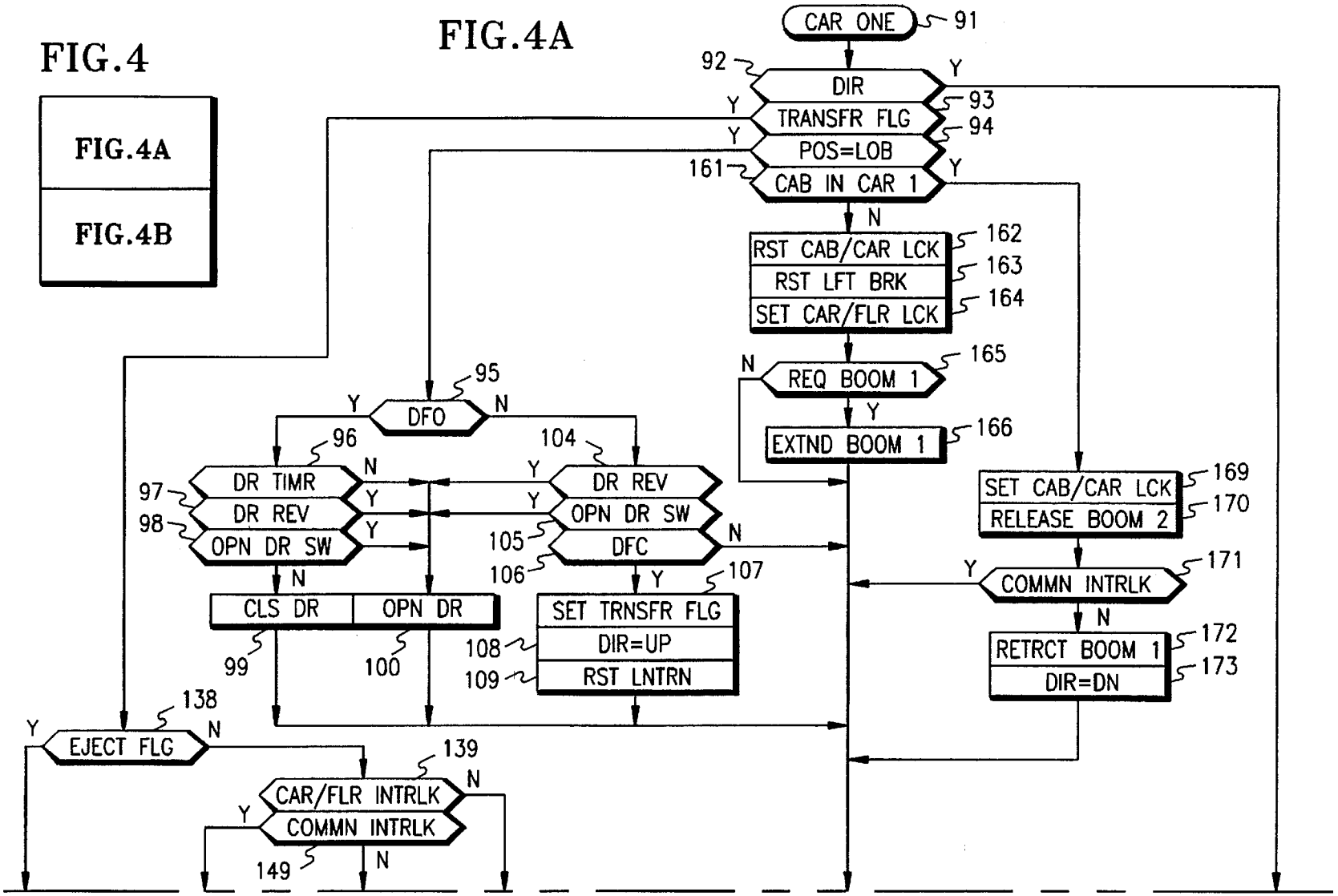
FIG. 4 is a logic flow diagram illustrating a routine which may be used controlling car one in the lowest shaft FIG. 1.
Figure 4B:
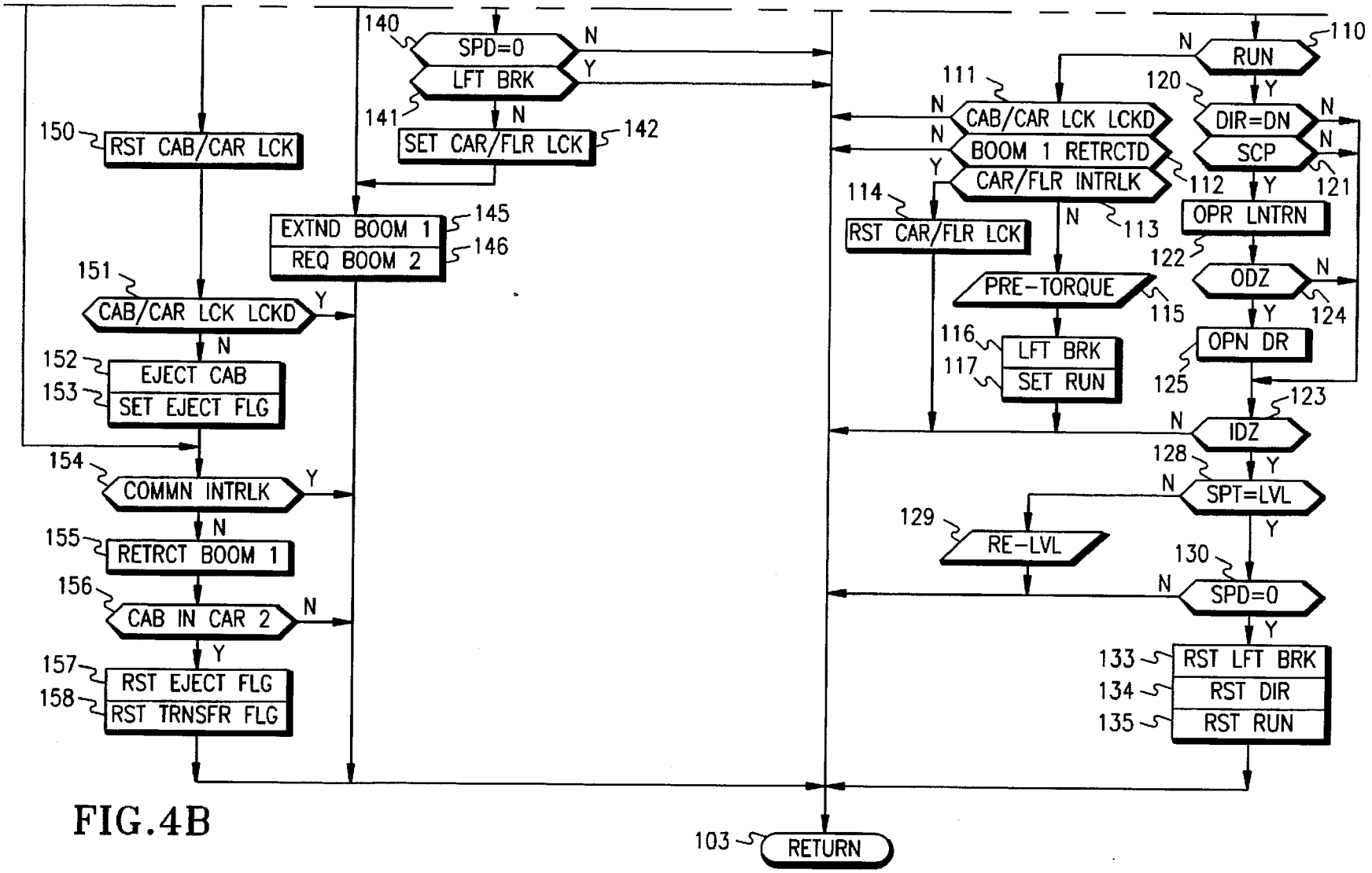

Referring now to FIG. 4, a control routine for car one may be implemented in a microprocessor which performs a variety of functions, not all of which are illustrated herein. The routine of FIG. 4 may be reached through an entry point 91 and a first test 92 determines if the car has motion direction commanded to it (that is, the command to go up or down). Assume that the elevator cab is in car one standing at the lower lobby floor 32 with its doors fully open. In such case, the car does not have direction, so a negative result of test 92 will reach a test 93 to see if a transfer flag has been set or not. This flag is set to keep track of the fact that when the car arrives at a transfer floor, it has the cab and must transfer it to the other car. Initially, this flag is not set, so a negative result of test 93 reaches a test 94 to see if the position of the car is the lobby floor (for car one, the lower lobby floor 32). Under the assumption, the car is at the lobby, so an affirmative result of test 94 reaches a test 95 to see if the doors are fully open. It is assumed that the doors are fully open, so an affirmative result of test 95 reaches a test 96 to see if a door timer has expired so that the doors should be closed, and if so, tests 97 and 98 to see if either the door reversal switch (on the doors which sense the presence of a passenger trying to enter) or the door open switch have been operated. If neither of these have been operated, then negative results of tests 97 and 98 will reach a step 99 to close the door. However, until it is time to close the door, a negative result of test 96 will reach a step 100 which reinforces the fact that the door should remain open. Similarly, after the timer has expired, if either a door reversal switch or an open door switch has been actuated by a passenger, then the open door step 100 will be reached. In any event, other parts of programming are then reverted to through a return point 103.

In a subsequent pass through the car control routine of FIG. 4, negative results of tests 92 and 93 and affirmative results of tests 94 and 95 will again reach the tests 96–98 to see if the door should remain open or be closed. Assuming that the timer has expired and passengers have not actuated either the door reversal switch or the open door switch, then the step 99 will order the cab to close the doors and other programming is reverted to through the step 103. In a subsequent pass through the routine of FIG. 4, once again negative results of reach step 95, will reach step 95, but this time the door is no longer fully open (while it is closing or after it is closed). Therefore, a negative result of test 95 will reach a pair of tests 104, 105 to see if a passenger has caused door reversal or pressed the open door switch, in which case the step 100 is again reached to open the door. But if not, negative results of steps 104 and 105 will reach a step 106 to see if the door has become fully closed or not. Initially it will not have so a negative result of test 106 will reach other programming through the return point 103. Eventually, the door will become fully closed and an affirmative result of test 106 will reach a step 107 which sets the transfer flag (indicating that the cab must later be transferred from the frame of car one to the frame of car two), a step 108 which commands car direction up, and a step 109 to reset the lobby corridor lantern. Then other programming is reached through the return point 103.

In the next pass through the routine of FIG. 4, test 92 is affirmative so a test 110 is reached to determine if the car has a run command yet or not. Initially it will not have so a negative result of test 110 reaches a test 111 to see if a cab/car lock is indeed locked. This may be a safety signal conducted by microswitches or contacts associated with the plungers 60 (FIGS. 2 and 3). The cab is locked to car one when it first enters the car (step 169, hereinafter), and remains locked until it is transferred to car two again (step 150, hereinafter). If the cab is locked, a test 112 determines if boom one is retracted (that is, boom 72 in FIGS. 2 and 3). If either of the tests 111, 112 is negative, the car is not allowed to run. As shown in the simple embodiment of FIG. 4, negative results simply bypass establishing the run condition for the car; however, in a more complete embodiment, negative results of test 111 and 112 may invoke alarms, intervention of maintenance personnel and ultimate evacuation of passengers. But if both tests 111 and 112 are affirmative, a test 113 determines if the car is still locked to the floor; at the lobby floor, the car/floor interlock is contemplated as a safety circuitry of contacts of switches that assure the plungers 56, 57 have engaged the plates 59, and that the car is at a lobby floor (e.g., no second car is involved). Initially, it is, so an affirmative result of test 113 reaches a step 114 to reset the car/floor lock, thereby retrieving the plungers 56 (FIG. 2). When the locks are released, in a subsequent pass through the routine, test 113 is negative and a pretorque subroutine 115 is reached in which the elevator motor is supplied with proper current so as to support the elevator load in anticipation of lifting the brake. And then a step 116 orders the brake to be lifted and a step 117 sets the elevator into the run mode. Thereafter, the computer reverts to other programming through the return point 103. Once in the run mode, the car motion controller, part of the car control 30 (FIG. 1), will cause the car to move in response to a speed profile in the usual way.

In the next pass through the routine of FIG. 4, an affirmative result of test 92 will reach test 110, which is now affirmative. A test 120 determines if the car direction is down. If it is, a test 121 determines if the car has reached the stop control point (SCP) for the lobby floor 32, or not. If it has, it will operate the lantern at the lobby floor 32 (not shown herein). If the car has not reached the stop control point, the routine bypasses the step 122 and reaches a test 123 to determine if the car has reached the inner door zone (IDZ); prior to reaching a stop control point, test 123 will naturally be negative, causing other programming to be reached through the return point 103. Eventually, the car will reach the stop control point, and in a subsequent pass through the routine of FIG. 4, test 121 will be affirmative so that step 122 will operate the lobby lantern (including a gong) in the usual fashion. Then a test 124 determines if the car has reached an outer door zone (ODZ); initially it will not, so the program will advance through negative results of tests 124 and 123 to the return point 103. Eventually, the car will reach the outer door zone, and a later pass through the routine of FIG. 4 will cause an affirmative result of test 124 to reach a step 125 which directs the doors to become open, in the usual fashion. Then, test 123 is reached and, initially, a negative result will cause other programming to be reached through the return point 103.

When the car reaches the inner door zone, an affirmative result of test 123 causes a test 128 to determine if the secondary position transducer (SPT) has indicated that the car is suitably level. If not, a negative result of test 128 reaches a subroutine 129 to relevel the car, in the usual fashion. When the car is level, an affirmative result of test 128 reaches a test 130 to ensure that the car speed is zero, which might not occur for some number of milliseconds and therefore for a few passes through the routine of FIG. 4. During all of this time that the elevator is running, it is running in response to the speed profile routine portion of the car controller 30, which brings the car to a complete stop at the floor; and it may be operated in response to the releveling subroutine 129. When the car is finally at rest, a pass through the routine of FIG. 4 will have an affirmative result of test 130 which reaches a step 133 to reset the lift brake command, thereby allowing the brake to fall and arrest all motion of the elevator roping system. A step 134 resets direction, and a step 135 resets the run mode.

In the scenario assumed hereinbefore—that the car is starting at the low lobby floor 32 with its cab's doors fully opened—the car will thereafter be running up, rather than down. Therefore, following steps and tests 95–108, affirmative results of tests 92 and 110 will reach a negative result of test 120 thereby bypassing steps and tests 121, 122, 124 and 125. Therefore, when running up, the first event is reaching the inner door zone, in which case an affirmative result of test 123 will check leveling and speed and thereafter drop the brake and reset direction and run mode, in the steps 133–135, as described hereinbefore.

After direction has been reset in the step 134, the next pass through the routine of FIG. 4 will once again have a negative result of test 92. This reaches test 93 once again, but this time, the transfer flag has previously been set in step 106 so an affirmative result of test 93 reaches that portion of the routine that causes the cab to be moved from frame 16 of car one to frame 17 of car two. A test 138 determines if an eject flag has been set, or not; this is a flag that identifies the fact that the cab is in transit between frame 16 and frame 17. Initially, it will not have been set, so a negative result of test 138 reaches a test 139 to see if a car/floor interlock has been established yet or not. The car/floor interlock is not shown in FIGS. 2 and 3, but in this embodiment it is contemplated as consisting of safety circuitry connected through contacts or microswitches on both cars at the transfer floor that will provide an affirmative signal to the test 139 only when all four plungers 56 are extended and all four plungers 57 are extended, meaning that both frame 16 and frame 17 are locked to the building floor. When car one first reaches the first transfer floor 33, the plungers 57 will already have been in place locking frame 17 to the building, but the plungers 56 will not as yet have been extended to lock frame 16 in place. Therefore, a negative result of test 139 reaches a test 140, to ensure that the car speed is still zero, and a test 141 to ensure that the brake has not been lifted, meaning it is safe to engage the plungers 57 and lock the car to the building floor. Thus, an affirmative result of test 140 and a negative result of test 141 will reach a step 142 to set the floor lock (which causes the plungers 56 to extend and engage the plates 58, 59) thus locking the frame 16 (at car one) to the building floor.

A step 145 then causes boom 1 to extend, which rotates the distal end thereof outwardly over the sill 60 (FIGS. 2 and 3) so as to cause the cab socket/plug assembly 69 to be in the position where it may be engaged by the socket/plug assembly 71 of car two. And a step 146 requests that boom 2 (that is, boom 73 on car two) be extended. This request is passed from the control of car one to the control of car two and utilized in the manner described with respect to the car two control of FIG. 5, hereinafter. After requesting that boom 2 be extended, the computer reverts to other programming through the return point 103.

In the next pass through the routine of FIG. 4, a negative result of test 92, an affirmative result of test 93, a negative result of test 138, and an affirmative result of test 139 will reach a test 149 to see if a communication interlock has been established or not. In this embodiment, this is contemplated as being a signal which must pass outwardly from the car one electric system, to the cab 14 through its umbilical cable 68, through connectors on socket/plugs 69, 71, back out through the umbilical cable 68, over circuits in the boom 73 and into the car two electric system, and back through the car one electric system. Since it takes more than a few milliseconds for the booms 72, 73 to extend toward each other, there may be quite a few passes through the routine of FIG. 4 during which a negative result of test 149 will cause a reinforcing of steps 145 and 146 to ensure that boom 1 extends and boom 2 is requested to be extended. Eventually, the booms will be sufficiently extended so that the three socket/plug assemblies 69–71 are interconnected, and therefore there will be completion of a communication interlock signal; an affirmative result of test 149 will reach a step 150 to reset the car/cab lock, thereby causing the plungers 60 (FIGS. 2 and 3) to retract and cause the cab 14 to become free of the frame 16. Then a test 151 may determine if the car/cab locks are clear or not. This may be done with microswitches or contacts on the plungers 60 to provide a signal only when all four plungers 60 are free of the cab 14. Since it will take more than a few milliseconds to move the car/cab lock plungers 60 into the unlocked condition, an affirmative result of test 151 will cause other programming to be reached through the return point 103. In a subsequent pass through the routine of FIG. 4, eventually, the car/cab locks will be clear so that a negative result of test 151 will reach a step 152 to eject the cab, which causes the jack screw assembly 44 to energize and push the cab off frame 16 over the sill 60 and onto the frame 17. As soon as the eject cab signal is provided, a step 153 also sets an eject flag to indicate that the cab is traveling between cars, in limbo.

As the cab 14 is moved horizontally by the jack screw assembly 44 from the frame 16 to the frame 17, the proximal end of the umbilical cord 68 will similarly move from being centered within the frame 16 to being centered within the frame 17 as the center of the cab moves from left to right in FIG. 2 (or vice versa). The umbilical cable 68 is, however, long enough so that connection between all three socket/plug assemblies 69–71 will be maintained until the cab 14 is in its new operational position on the frame 17. When that happens, as is described with respect to FIG. 5 hereinafter, the car two control will request release of boom one so that a plunger on the socket/plug assembly 69 will push the socket/plug assembly 70 out of contact with the socket/plug assembly 69. When this occurs, the communication interlock is broken because it no longer extends from the car one control through boom 72 to the cab, through boom 73, through the car two control to the car one control. Therefore, a test 154 will be affirmative until car two requests release of boom 1 in the manner described hereinafter; but once boom 1 is released from the socket/plug assembly 69, the communication interlock will be broken, so a negative result of test 154 will reach a step 155 which causes boom 1 to retract (that is, rotate its distal end to the left in FIGS. 2 and 3) so as to ensure that it will not interfere with the motion of car two. A test 156 determines if the cab has been transferred sufficiently onto the frame 17 so as to activate the proximity sensor 64 (FIG. 2), thereby indicating that the cab is in car two. As the cab is moved from one frame to the other, it will initially not be fully on the second frame, and therefore a negative result of test 156 will cause other programming to be reached through the return point 103.

Subsequent passes through the routine of FIG. 4, as the cab continues to be moved toward car 2, will find a negative result of test 92, and affirmative results of tests 93 and 138, reaching test 154. Once the communication interlock is broken, a negative result of test 154 will reach test 156. Eventually, the cab will be fully on the frame 17 so that the proximity sensor 64 will provide a cab in car two signal, and an affirmative result of test 156 will reach a step 157 to reset the eject flag (which indicated that the cab had to be ejected from car one) and a step 158 to reset the transfer flag (which indicated that the cab was moving between car one and car two).

Now that the cab has been transferred from car one to car two, car one simply sits and waits until car two brings the cab back down to the first transfer floor 33, after which the cab will be transferred back into car one. In all of the ensuing passes through the routine of FIG. 4, negative results of tests 92 and 93 reach test 94 to see if the car is at the lobby; since it is not, a test 161 senses if the cab is in car one. In this case, it is not, so a negative result of test 161 reaches a step 162 which simply reaffirms that the plungers 60 are out of the way, a step 163 which reaffirms that the brake is not lifted, and a step 164 which reaffirms that the car one frame 16 is locked to the floor by means of the plungers 56. Then a test 165 determines if car two is trying to transfer the cab over to car one, in which case it would request that boom 1 be extended. Eventually, the cab will be brought back to the first transfer floor 33 by car two, and as is described more fully with respect to FIG. 5, car two will request that boom 1 be extended so as to make communication between the cab and car one so the cab can be transferred to car one. When that happens, an affirmative result of test 165 will reach a step 166 to extend boom 1 (into the position shown in FIGS. 2 and 3). In the next several passes through the routine of FIG. 4, a negative result of test 161 will again cause all of the steps and tests 162–166 to be repeated. This is the period of time when the cab is transferring from car two to car one.

Eventually, the car two jack screw assembly 45 will have pushed the cab 14 all the way onto frame 16 of car one (as seen in FIGS. 2 and 3) so that the proximity sensor 63 of car one picks up the fact that the cab is now in car one. The next pass through the routine of FIG. 4 will reach an affirmative result of test 161, which reaches a step 169 to set the cab/car lock (plungers 60) and a step 170 to release boom 2, which causes a plunger on the right hand side of the socket/plug assembly 69 to push the socket/plug assembly 71 away, thereby separating boom 2 therefrom, while leaving the cab connected to boom 1. Then a test 171 determines if the communication interlock has been broken (that is, if the socket/plug assembly 71 has separated from the socket/plug assembly 69). Initially it may not be separated, so the communication interlock signal is still being provided, and an affirmative result of test 171 will cause the computer to revert to other programming through the return point 103. As soon as the communication interlock is broken, in a next pass through the routine, a step 172 causes boom 1 to retract, and a step 173 sets the car one direction command to down.

The very next pass through the routine of FIG. 4 therefore has an affirmative result of test 92 so that all of the tests and steps 110–135 will be repeated as the elevator will start up, travel downwardly, open its doors and become level at the low lobby floor 32.

Figures 5, 5A:
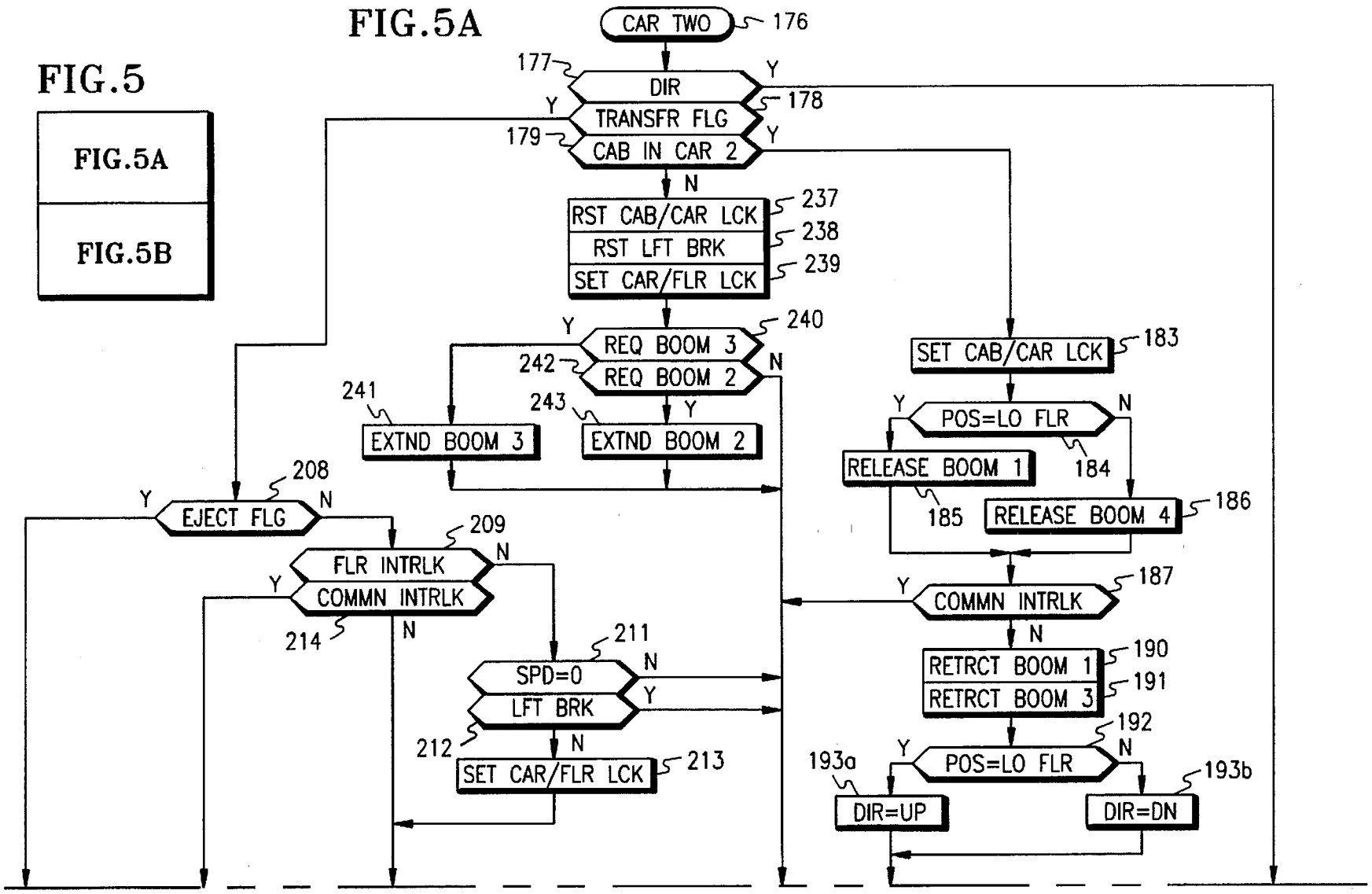
FIG. 5 is a logic flow diagram illustrating a routine which may be used controlling car two in the middle shaft of FIG. 1.
Figure 5B:
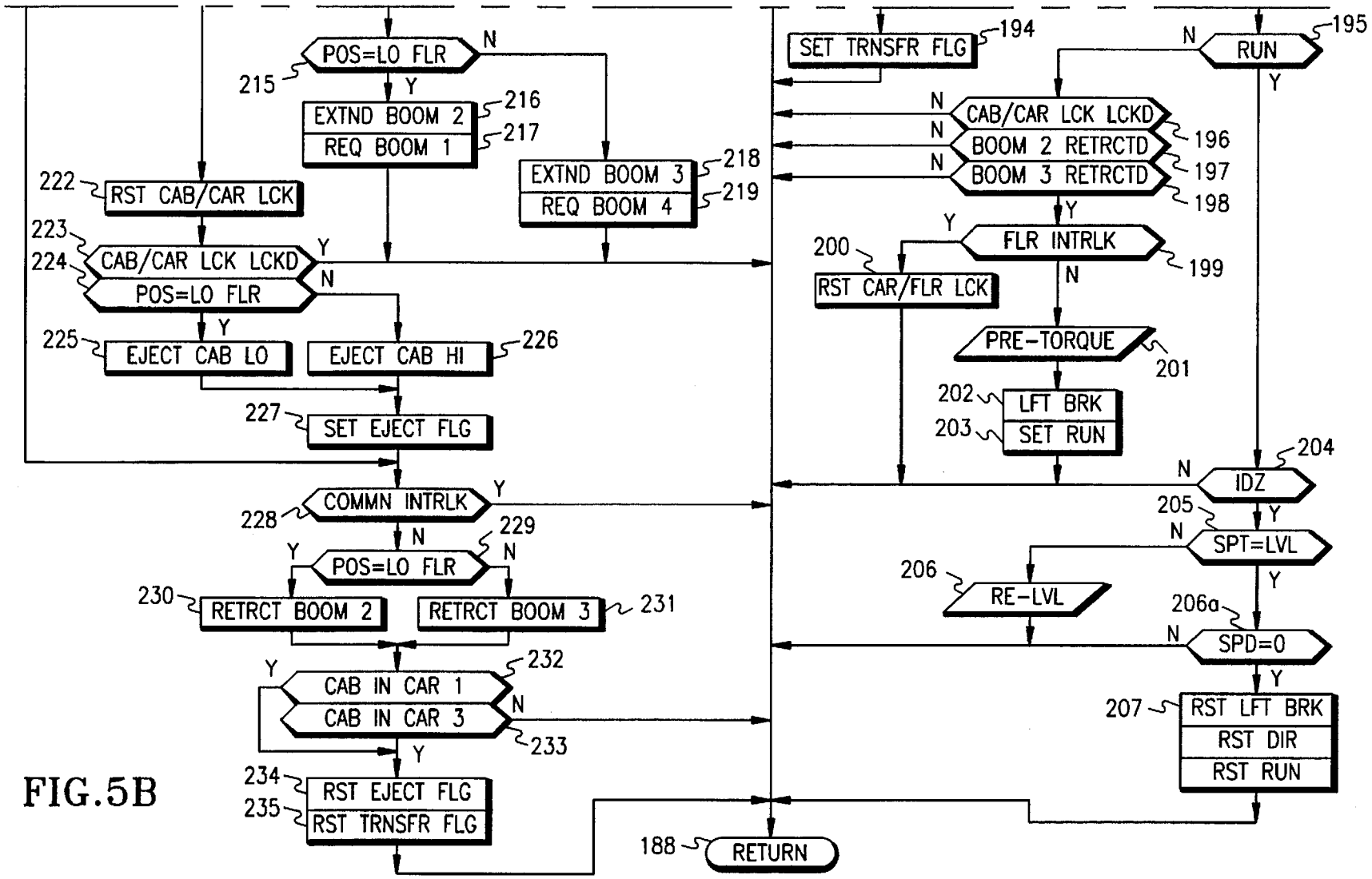

A control routine for car two is illustrated in FIG. 5. The control for car two differs from that of car one mainly in two respects: since it travels between two transfer floors, there is no door control function required; and since the cab is transferred between car one and car two on the left side of car two (as seen in FIGS. 2 and 3) but is transferred between car two and car three on the right side of car two, two booms 73, 78 are controlled separately by the car two controller.

The car two routine is reached through an entry point 176 and a first test 177 determines if the car has direction or not. Assume that the cab 14 has just been transferred from car one to car two. In this case, car two will not yet have direction, so a negative result of test 177 reaches a test 178 to see if a transfer flag (similar to the transfer flag of car one) has been set or not. Initially it will not have been, so a negative result of test 178 reaches a test 179 to determine if the cab is in car two. Under the assumption, it is, so an affirmative result of test 179 reaches a step 183 to set the cab/car lock, causing the plungers 61 to engage the cab. A test 184 determines if car two is at the lower transfer floor 33, or not. If it is (as in the present assumption), an affirmative result of test 184 reaches a step 185 to release boom 1 which will cause a plunger on the left side of the socket/plug assembly 69 to push the socket/plug assembly 70 away from it. On the other hand, if car two were at the upper transfer floor 34, a negative result of test 184 would reach a step 186 to release boom 2, which would case a plunger on the right hand side of the socket/plug assembly 69 to push a corresponding socket/plug assembly on boom 4 (of car three, on frame 18, not shown) to cause it to disconnect. A test 187 determines if the communication interlock is still present, which it will be for a few milliseconds, so an affirmative result of test 187 causes the computer to revert to other programming through a return point 188. Note that the fact that the cab is in communication with (hooked up to) car two was established, by test 149 (FIG. 4), before the cab was ejected from car one. In the next pass through the routine of FIG. 5, negative results of tests 177 and 178 and an affirmative result of test 179 will again cause the steps 183 and 185 to be redundantly performed. If the communication link has now been broken, a negative result of test 187 will reach a step 190 to retract boom 2 and a step 191 to retract boom 3 (only one of these actually needs retracting; the other step is redundant but does no harm). Then a test 192 determines if car two is located at the low transfer floor. If it is, a step **193*a* sets the car two direction to up, but if it is not, a step 193*b* will set the car two direction to down. And then, a step 194 sets the transfer flag to keep track of the fact that on the other end of this run, the cab is to be moved from car two onto car three, and other programming is reached through the return point 188**.

On the next pass through the routine of FIG. 5, since the car now has direction, test 177 will be affirmative reaching a test. 195 to see if the car is in the run mode. Initially it will not be so a negative result of test 195 reaches a test 196 to see if the cab/car lock is locked or not (to see if the plungers 61 have engaged the cab 14, or not). If so, a test 197 determines if boom 2 has been retracted and a test 198 determines if boom 3 has been retracted. With the cab locked and the booms retracted, an affirmative result of test 198 reaches a test 199 to sense if the car is still locked to the floor. Initially it is, and an affirmative result of test 199 reaches a step 200 to reset the car/floor lock, thereby retrieving the plungers 57. In a subsequent pass with the floor locks released, a negative result of test 199 reaches a subroutine 201 to pretorque the elevator motor to remove all strain from the brake. Then a step 202 will cause the brake to be lifted and a step 203 will set the control into the run mode. Other programming is then reverted to through the return point 188. At this point, the speed control takes over running the elevator, causing it to advance upwardly in accordance with a dictated speed profile, all in a known fashion.

In the very next pass through the routine of FIG. 5, test 177 is affirmative and now test 197 is also affirmative. This reaches a test 204 to determine if the car has reached the inner door zone of the next floor (the upper transfer floor 34, under the assumption). Initially, it will not have, so other programming is reverted to through the return point 188. When the car finally reaches the inner door zone for the upper transfer floor 34, an affirmative result of test 204 reaches a test 205 to see if the car needs releveling; if it does, a subroutine 206 will relevel the car; if it does not, an affirmative result of test 205 reaches a test 206 to see if the speed has settled to zero yet or not. When it has, an affirmative result of test 206 reaches a series of steps 207 which cause the brake to drop, reset car direction, and reset the car two control from being in the run mode. Then, other programming is reached through the return point 188. Now the car is standing at the upper transfer floor 34 with the cab still on it.

In the next pass through the car two routine of FIG. 5, test 177 is once again negative, but this time test 178 is affirmative indicating that the cab has to be moved by the jack screw assembly 46 from car two onto car three. This reaches a step 208 to determine whether an eject flag has been set or not. Initially, it will not have been so a negative result of test 208 reaches a test 209 to see if the floor interlock signal is present, indicating that the frame 14 has been locked to the floor 33 by the plungers 57. If not, a test 211 determines if the car speed is still zero and a test 212 determines that the brake has not been lifted. If the car is braked and still, a step 213 will cause the floor locks to be engaged by operating the plungers 57. In the present embodiment, if the speed is not zero or the brake has been lifted, other programming is reverted to. In a more complete embodiment, a negative result of test 211 or an affirmative result of test 212 might result in an alarm condition and/or cause maintenance intervention.

When the floor interlock is established, the next pass through the routine of FIG. 5 will reach a test 214 to see if the communication interlock signal is present or not. Initially, it will not be, so a negative result of test 214 reaches a test 215 to see if the car two position is at the lower floor 33. If it is, an affirmative result of test 215 reaches a step 216 to extend boom 2 and a step 217 to request that boom 1 be extended. However, in the present example, the car is Standing at the upper transfer floor 34 so a negative result of test 215 reaches a step 218 to extend boom 3 and a step 219 to request that boom 4 be extended. Then other programming is reached through the return point 188. In the next pass through the car two routine of FIG. 5, a negative result of test 177, an affirmative result of test 178, a negative result of test 208 and an affirmative result of test 209 will again reach the test 214 to see if the communications are hooked up yet, or not. If not, the steps and tests 215–219 will be repeated, appropriately, as described hereinbefore. Eventually, when the booms are interconnected, test 214 is affirmative and a step 222 causes the cab/car lock to be reset by withdrawing the plungers 61. This readies the cab to be moved by the jack screw assembly 46 from car two onto frame 18 of car three. Then a test 223 determines if a signal, indicating that the cab/car locks have all cleared the car, is present or not. When present, an affirmative result of test 223 reaches a test 224 to determine if the car is at the low floor 33 or not. If it is, it reaches a step 225 to operate the jack screw assembly 45 and eject the car toward car one. But in the present example, the car is now at the upper floor 34 so that the jack screw assembly 46 will be operated instead, in response to a step 226. And then a step 227 sets the eject flag to keep track of the fact that the cab is being transferred between cars.

A test 228 determines if the communication interlock signal has been broken yet, or not. Initially it will not have been, so other programming is reached through the return point 188. In the next pass through the car two routine of FIG. 5, test 208 is affirmative reaching test 228 directly; for some number of passes through the routine of FIG. 5, communications will still be effective between car two, the cab, and car three, so affirmative results of test 228 will cause other programming to be reached through the return point 188. Eventually however, boom 3 will be released by car three exercising a step equivalent to step 170 in the car one routine of FIG. 4, so that the socket/plug assembly 80 on boom 78 (boom 3) of car two will be ejected from the cab/socket plug assembly 69. In the next pass through the car two routine of FIG. 5 after disconnecting boom 3 from the cab, a negative result of test 228 will reach either step 230 or 231 depending on which transfer floor the car is at, determined by a test 229; whichever boom needs retracting will be retracted, the other boom is not affected. Then a test 232 determines if the cab has been indicated to be in car one, which in this example cannot occur. A test 233 determines if the cab is in car three, which will eventually be the case in the present circumstance. Initially, however, the car is transferring between car two and car three so a negative result of test 233 causes other programming to be reached through the return point 188. After the cab has been pushed completely onto frame 18 of car three, an affirmative result of test 233 will reach a step 234 to reset the eject flag and a step 235 to reset the transfer flag. Then other programming is reached through the return point 188.

At this point in the process, car two is now standing empty at the upper transfer floor 34. The next pass through the car two routine of FIG. 5 will find a negative result of test 177, a negative result of test 178, and a negative result of test 179. This reaches a step 237 to assure that the plungers 61 which form the cab/car lock are retracted, a step 238 to assure the brake is not lifted, and a step 239 to assure that the car is Still locked to the floor (by means of the plungers 57). A test 240 determines if car three has requested boom 3; if it has, this means that the trip for the cab in the hoistway 13 is complete and car three has returned to the upper transfer floor 34 and now wishes to push the cab back to car two. Therefore, an affirmative result of test 240 reaches a step 241 to extend boom 3 in order to reestablish communication with the cab. On the other hand, if boom 3 is not requested, a test 242 determines if boom 2 is requested (at the bottom of shaft 12). If so, a step 225 causes boom 2 to be extended. Whenever the cab is away from the upper floor 34 in car three or away from the lower floor 33 in car one, both tests 240, 242 will be negative, causing programming to revert through the return point 188. In other words, whenever the cab is away from car two, it simply reassures that conditions are correct and nothing else occurs. When the cab is returned to being adjacent car two, one or the other of the booms is requested, which will initiate further operation.

Assuming that the cab has returned to the upper transfer floor in car three and that the car three jack screw assembly 47 has pushed the cab 14 back onto the frame 17 of car two, the next pass thereafter through the car two routine of FIG. 5 will find a negative result of test 177, a negative result of test 178, and an affirmative result of test 179, because the cab is once again in car two. This causes the steps and tests 182–194 to be performed as described hereinbefore, except that in this case, boom 4 is released in step 186 and the direction is set to down in the step **193*b***. Then the car will travel downward in the same fashion as described for the upwardly-traveling car hereinbefore.

The car three controller may be the same as the car one controller of FIG. 4 with the exceptions that step 108 will be down, test 120 will be up, step 146 will refer to boom 3, and steps and tests 112, 145, 155, 165, and 166 will all relate to boom 4.

In FIGS. 4 and 5, the tests 92–94, 161 and 177–179 (as well as similar tests for car three, and equivalent tests in embodiment at variations of the invention) may be performed in various orders, as well as in the order shown. However, care must be taken: for instance, it may appear to be logical for test 161 (car in cab 1) to be first, since nothing need be done, but wait, when the car is empty; but this would remove control over the transferring process once the car begins to move out of car one, and therefore should subserve the transfer flag test 93. The transfer flag test, 93, therefore cannot be last, since it must maintain control when the cab is leaving the car. And, the choice between transfer or not and door operations or not is best made only when the car has no direction command (e.g., tests 93 and 94 following test 92 in FIG. 4).

The invention is disclosed as using simple jack screw systems 44, 45 which permit each car to push the cab off itself onto another car; however, the best mode for transferring a cab between cars might be that disclosed in commonly owned U.S. patent application Ser. No. 08/663,869, filed Jun. 19, 1996, a continuation-in-part of Ser. No. 08/564,704, filed Nov. 19, 1995, described briefly with respect to FIG. 6.

Figure 6:
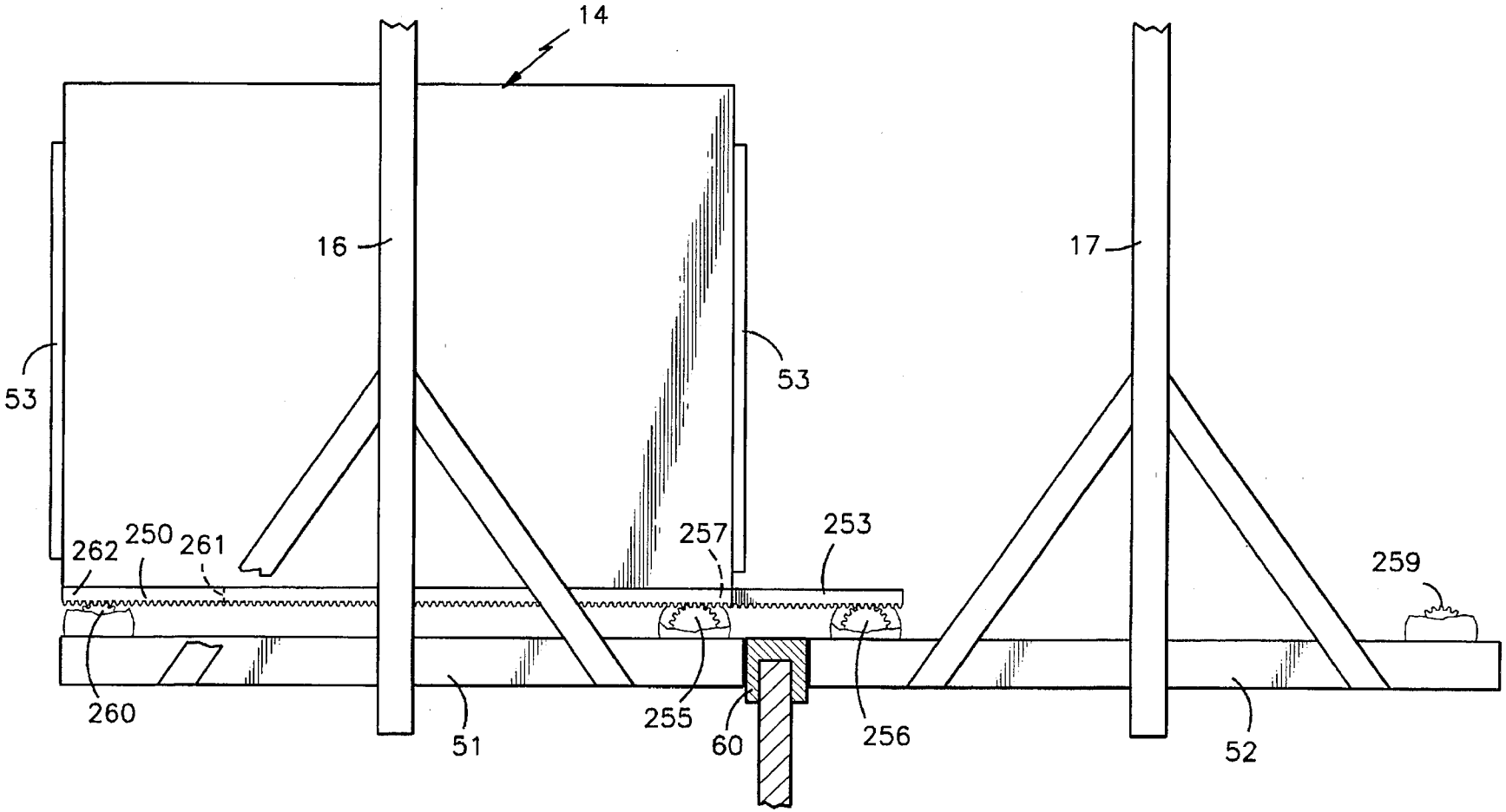
FIG. 6 is a simplified side elevation view of car frames and a cab, illustrating a second horizontal motive means which the invention may use.

In FIG. 6, the bottom of the cab 14 has a fixed, main rack 250 extending from front to back (right to left in FIG. 6), and a sliding rack 253 that can slide outwardly to the right, as shown, or to the left. There are a total of four motorized pinions on each of the car frame platforms 51, 52. First, an auxiliary motorized pinion 255 turns clockwise to drive the sliding auxiliary rack 253 out from under the cab into the position shown, where it can engage an auxiliary motorized pinion 256 on the platform 52, which is the limit that the rack 253 can slide. Then, the auxiliary motorized pinion 256 will turn clockwise pulling the auxiliary rack 253 (which now is extended to its limit) and therefore the entire cab 14 to the right as seen in FIG. 6 (on rollers or wheels 50, not shown in FIG. 6) until such time as an end 257 of the main rack 250 engages a main motorized pinion (not shown) which is located just behind the auxiliary motorized pinion 256 in FIG. 6. Then, that main motorized pinion will pull the entire cab 14 fully onto the platform 52 by means of the main rack 250, and as it does so a spring causes the slidable auxiliary rack 253 to retract under the cab 14. An auxiliary motorized pinion 259 can assist in moving the cab 14 to the right to another car frame or landing (if any). Similarly, an auxiliary pinion 260 can assist in moving a cab from a car frame or landing to the left of that shown in FIG. 6 (if any) onto the platform 51.

To return the cab 14 from the platform 52 to the platform 51, the auxiliary pinion 256 will operate counterclockwise, causing the sliding, auxiliary rack 253 to move outwardly to the left until its left end 261 engages the auxiliary pinion 255. Then the auxiliary pinion 255 rotates conterclockwise and pulls the auxiliary rack 253 and the entire cab 14 to the left until the left end 262 of the main rack engages a main motorized pinion (not shown) located behind the auxiliary motorized pinion 255, which then pulls the entire cab to the left until it is fully on the frame 51.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. An elevator system for a building having a plurality of levels, comprising:

a plurality of overlapping elevator hoistways, each having an elevator car frame movable from a low end of the corresponding hoistway to a high end of the corresponding hoistway, each hoistway except the lowest of said hoistways in said building having its low end at the same building level as the high end of another of said hoistways, each hoistway except the highest of said hoistways in said building having its high end at the same building level as the low end of another one of said hoistways, said lowest of said hoistways having a passenger lobby at its low end, said highest of said hoistways having a passenger lobby at its high end;

a horizontally moveable elevator cab having passenger access doors;

selectively operable horizontal motive means for moving said cab horizontally from a first one of said car frames to a second one of said car frames or, alternatively, from said second car frame to said first car frame;

means for sensing the presence of said cab in any one of said car frames and providing a corresponding cab-in-car signal indicative thereof;

means for sensing the position of said car frames in said hoistways and providing corresponding position signals indicative thereof;

signal processing means responsive to said position signals indicating that one of said car frames is at a corresponding one of said lobby floors for providing door control signals to open and close said doors for transfer of passengers, for providing, after said cab doors have been open and are fully closed, a first car direction command for said one car frame indicating a direction away from said one lobby floor and a transfer signal indicative of the fact that said cab shall be transferred from said one car frame to another of said car frames, said signal processing means, in response to said position signals indicating that said car frame is at a location other than one of said lobby floors concurrently with the absence of either of said direction commands for said one car frame and the presence of said car-in-cab signal for said one car frame, either operating said motive means in response to said transfer signal for said one car frame and thereafter removing said transfer signal, or otherwise, in the absence of said transfer signal for said one car frame, providing a second car direction command for said one car frame indicating a direction away from said location; and a car motion means for each of said car frames, each responsive to the presence of corresponding ones of said car direction commands for moving the corresponding car frame along its hoistway in the direction indicated by the present one of said corresponding car direction commands.

2. An elevator system according to claim 1 wherein in the absence of said cab-in-car signal and said transfer signal for said one car frame, said one car frame awaits the transfer of said cab to it.

3. An elevator system, comprising:

a plurality of overlapping elevator hoistways, each extending between a corresponding lower terminal level and corresponding upper terminal level, one terminal level of each of said elevator hoistways being coextensive at a transfer floor with one terminal level of another one of said elevator hoistways, the lower terminal level of one of said elevator hoistways comprising a lower lobby and the upper terminal level of another of said elevator hoistways comprising an upper lobby, any of said terminal levels which does not comprise a lobby comprising a transfer floor;

a plurality of elevator cars, each comprising a frame movable between said terminal levels of a corresponding one of said hoistways;

a horizontally moveable elevator cab;

selectively operable motive means for moving said cab horizontally, from a first one of said car frames to a second one of said car frames or, alternatively, from said second car frame to said first car frame;

means for sensing the presence of said cab in any one of said car frames and providing a corresponding cab-in-car signal indicative thereof;

means for sensing the position of said cars in said hoistways and providing corresponding position signals indicative thereof;

signal processing means for providing a transfer signal for each one of said cars each time the corresponding car runs toward one of said transfer levels, said signal processing means comprising means, responsive to the absence of a car direction command signal for said one car in the presence of the corresponding one of said cab-in-car signals, for either in the absence of said transfer signal, providing a car direction command signal for said one car indicative of a direction command away from said one level, or in the presence of said transfer signal, operating said motive means to transfer said cab from said one car to another one of said cars and thereafter removing said transfer signal; and a car motion means for each of said cars, each responsive to the presence of corresponding ones of said car direction commands for moving the corresponding car along its hoistway in the direction indicated by the present one of said corresponding car direction commands.

4. An elevator system according to claim 3 wherein in the absence of said car-in-cab signal and said transfer signal for said one car, said one car awaits the transfer of said cab to it.

5. An elevator system, comprising:

a plurality of overlapping elevator hoistways, each extending between a corresponding lower terminal level and corresponding upper terminal level, one terminal level of each of said elevator hoistways being coextensive at a transfer floor with one terminal level of another one of said elevator hoistways, the lower terminal level of one of said elevator hoistways comprising a lower lobby and the upper terminal level of another of said elevator hoistways comprising an upper lobby, any of said terminal levels which does not comprise a lobby comprising a transfer floor;

a plurality of elevator cars, each comprising a frame moveable between said terminal levels of a corresponding one of said hoistways;

a plurality of car motion means, one for each of said cars, each for moving the corresponding car frame along its hoistway;

a horizontally moveable elevator cab;

selectively operable horizontal motive means for moving said cab horizontally, from within a first one of said car frames to within a second one of said car frames or, alternatively, from within said second car frame to within said first car frame; and a controller for alternatively operating said motive means to transfer said cab from within one of said car frames to within another one of said car frames or commanding the one of said car motion means corresponding to a car frame having said cab within it to move the corresponding car along its hoistway.

* * * * *